US008795563B2

(12) United States Patent
Splinter

(10) Patent No.: US 8,795,563 B2
(45) Date of Patent: Aug. 5, 2014

(54) ROLL PRESS COMPRISING TWO MOBILE ROLLS

(75) Inventor: Christian Splinter, Pulheim (DE)

(73) Assignee: KHD Humboldt Wedag GmbH, Cologne (DE)

( * ) Notice: Subject to any disclaimer, the term of this patent is extended or adjusted under 35 U.S.C. 154(b) by 1094 days.

(21) Appl. No.: 12/745,846

(22) PCT Filed: Dec. 1, 2008

(86) PCT No.: PCT/EP2008/066550

§ 371 (c)(1),
(2), (4) Date: Aug. 23, 2010

(87) PCT Pub. No.: WO2009/071514

PCT Pub. Date: Jun. 11, 2009

(65) Prior Publication Data

US 2010/0310702 A1 Dec. 9, 2010

(30) Foreign Application Priority Data

Dec. 7, 2007 (DE) ..... 10 2007 059 072

(51) Int. Cl.
*B30B 3/04* (2006.01)
*B30B 15/04* (2006.01)

(52) U.S. Cl.
USPC ..... 264/175; 100/170; 100/176; 241/231; 241/234; 425/363; 425/367

(58) Field of Classification Search
USPC ..... 425/363, 367; 100/170, 176; 241/231, 241/234; 264/175
See application file for complete search history.

(56) References Cited

U.S. PATENT DOCUMENTS

| | | | | |
|---|---|---|---|---|
| 4,154,408 | A | 5/1979 | Boling, Jr. | |
| 7,699,254 | B2 * | 4/2010 | Frangenberg et al. | 241/231 |
| 7,896,272 | B2 * | 3/2011 | Frangenberg et al. | 241/135 |
| 2008/0149749 | A1 | 6/2008 | Frangenberg et al. | |

FOREIGN PATENT DOCUMENTS

| | | | |
|---|---|---|---|
| DE | 1100432 | | 2/1961 |
| DE | 10 2006 004 282 | * | 8/2007 |
| WO | WO 2006/084652 | | 8/2006 |

* cited by examiner

*Primary Examiner* — James Mackey
(74) *Attorney, Agent, or Firm* — Greer, Burns & Crain Ltd.

(57) ABSTRACT

A roll press for the compression or compacting of granular products. Two detachable rolls separated by a roll gap are driven in opposite directions and mounted on shafts to rotate in a machine frame. The shafts of the mobile rolls are received in bearing housings arranged in a mobile manner in the machine frame. Two respective bearing housings of different rolls, arranged on one side of the rolls, are interconnected by at least one pressure cylinder having at least two working chambers. A method for centering mobile rolls in such a roll press. The at least two working chambers have a force effect acting in opposite directions, and are interconnected in such a way that a pressure medium can circulate between the chambers. In this way, the hydraulic system is positioned in a fixed manner on the machine frame, the rolls nonetheless being mounted in the machine frame in a floating manner.

12 Claims, 3 Drawing Sheets

ROLL PRESS COMPRISING TWO MOBILE ROLLS

BACKGROUND OF THE INVENTION

The invention relates to a roll press for the compression or compacting of granular products, having two mobile rolls, separated by a roll gap, which respectively are mounted rotatably in a machine frame by means of a shaft and are driven in opposite directions, wherein the shafts of the mobile rolls are accommodated in bearing housings arranged movably in the machine frame, and wherein respectively two bearing housings of different rolls, arranged on one side of the rolls, are interconnected by means of at least one pressure cylinder having at least two working chambers, and further relates to a method for centering mobile rolls in a roll press of the abovementioned type.

For the centering of rolls in roll presses for the compression or compacting of granular products, the rolls are generally held in their desired position by large-sized hydraulic drives in order that, on the one hand, the pressure in the roll gap between the rolls is maintained and, on the other hand, as a result of the centering, the parallelism of the limit of the roll gap is maintained by the surface of the rolls. In this centering, the hydraulic drives operate at high force both to maintain the parallelism of the roll gap and to maintain the pressure in the roll gap. To this end, in the simplest case, a first roll is mounted as a fixed roll immovably in bearings which, for their part, are fastened to extension arms by bearing housings in a machine frame. By contrast, a second roll is mounted as a mobile roll in bearings which are disposed in bearing housings arranged movably between two extension arms of the machine frame. The hydraulic drives for the relative positioning of the mobile roll in relation to the fixed roll and for the maintenance of the pressure in the roll gap exert high forces upon the machine frame as a counter bearing, for which purpose it is necessary to design the machine frame in correspondingly stable configuration.

In roll presses having rolls of sometimes far more than 50 tonnes in weight, a correspondingly large dimensioning of the machine frame is necessary, so that the logistics of the machine frame and its handling whenever the rolls need, in turns, to be changed, is complex, and is only possible with correspondingly large-sized cranes and removal aids.

In order to reduce the overall dimensions of the necessary dimensioning of the machine frame, in DE 10 2006 006 090 it is proposed to configure both rolls of the roll press as a mobile roll, these two mobile rolls being interconnected by means of the bearings and the bearing housings and by means of hydraulic drives. The rolls, the bearings, the bearing housings and the hydraulic drives here form a closed system of forces, which relieves the machine frame of load with the result that this can be dimensioned in smaller overall size. This arrangement has proved itself in practice. In order to change the rolls, it is necessary, however, to dismantle the machine frame and separate the bearing housings from the pressure cylinders. Since the pressure cylinders are part of a closed system of forces, a free suspension of the heavy pressure cylinders is necessary, the result of which is that the hydraulic lines must be flexible hoses. In order to keep the viscosity-dictated resistance of the pressure medium when flowing through the lines as low as possible, it is also necessary to keep the flexible lines short. When dismantling the roll press, it is thus necessary to separate the very heavy pressure cylinder, which is solely part of the abovementioned closed system of forces, from the fixed pump, in which case the hydraulics, namely pumps, lines and cylinders, have to be again refilled and deaerated when put back together. The effort involved in changing the rolls is hence relatively high, whereby the costs of the roll change are higher than in roll presses having a mobile and a fixed roll.

SUMMARY OF THE INVENTION

The object of the invention is therefore to provide a roll press and a roll centering method which calls for a machine frame of smaller overall dimension and the rolls of which are easier to change.

The object according to the invention is achieved by the roll press having the features of the independent claims and by the roll-centering method according to the invention, applied in this roll press, comprising the steps of the method claims. Advantageous embodiments of the invention are defined in the dependent claims.

The roll press according to the invention for the compression and compacting of granular products has two mobile rolls, separated by a roll gap, which respectively are mounted rotatably in a machine frame by means of a shaft and are driven in opposite directions. It is here provided that the shafts of the mobile rolls are accommodated in bearing housings arranged movably in the machine frame. Two bearing housings of different rolls, arranged respectively on one side of the rolls, are interconnected by means of at least one pressure cylinder having at least two working chambers.

According to the invention it is proposed that the working chambers of the at least one pressure cylinder have an oppositely directed force effect and are interconnected in such a way that pressure medium can circulate.

An advantage of the inventive connection of the pressure cylinders with opposite direction of force and with connection of the working chambers in such a way that pressure medium can circulate is that the working cylinder can be fixedly connected to the machine frame. In the case of the fixed connection of the at least one working cylinder to the machine frame, the at least one working cylinder cannot exert upon the machine frame any radially directed force, in relation to the rolls, which surpasses the force generated by the friction of the hydraulic piston in the working cylinder. For, as a result of the oppositely directed force of the different working chambers and as a result of the mutual connection of the working chambers, any force effect which is transmitted to the machine frame by a working chamber of a pressure cylinder is compensated by the force of the opposite working chamber of the same pressure cylinder. The force closure for compensation of the forces upon the machine frame is here established by means of the pressure medium. The machine frame, however, absorbs forces which are axially directed in relation to the rolls and which are generated, for instance, by a change of rotary position or by axial eccentricities of the rolls.

The fixed connection of the pressure cylinder to the machine frame makes it possible to connect the pressure cylinder by means of fixed pipe lines of large internal diameter to the pumps which feed them. As a result of this arrangement, it is not necessary in the roll change to remove the pressure cylinder, temporarily fasten it or separate it from the hydraulics. Similarly, as a result of the possible use of the pipe lines of large internal diameter, the viscosity-dictated resistance of the pipe lines can be lowered and, in the event of shocks in the roll gap caused by larger grinding stock particles or by unwanted particles which are not amenable to pressure crushing, the shocks are transmitted with less high pressure build-up into the larger-sized pipe lines by the pressure medium in the hydraulics system.

The two rolls, despite the pressure cylinders which interconnect them and are fixedly disposed in the machine frame, are mounted floatingly in the machine frame. The pressure cylinders can thus control the width of the roll gap, but not the position of the roll gap. The centering method according to the invention thus combines the advantages of different roll press types, namely those having a fixed roll and those having two mobile rolls.

In a preferred embodiment of the invention, it is provided that in one cylinder of the pressure cylinders two pistons are provided, which divide the cylinder into three chambers. Each piston is connected to a drag link, each respective drag link being drawn out to the one side, respectively, of the cylinder. The two outer chambers are used as working chambers. This means that, when the working chambers are pressurized, both outdrawn drag links are drawn by the respective piston inwards into the cylinder. The chamber which is configured between the two pistons is filled either with compressed air or with inert gas, the pressure in the middle working chamber being used to overcome the friction of the pistons in the cylinder, though it is also possible to evacuate the working chamber in order that the pistons can bang together without generating an opposite pressure through compression of the gas in the middle chamber. In the simplest case, the middle working chamber is amenable to a selective aeration and deaeration by a valve. It is conceivable to make the middle working chamber fillable and likewise to subject it to pressure medium, for instance, to move the rolls apart. In this case, the stroke of the pistons in the cylinder is restricted to prevent the pistons from moving over the position of the supply valve of the middle working chamber and thus rendering the middle working chamber powerless and short-circuiting the supply lines of the middle and outer working chambers.

The mutual connection of the working chambers produces a force compensation and this connection also allows the use of a single pump for the pressure generation, which pump generates the pressure simultaneously for all working chambers. It is thus not only possible to interconnect the working chambers of a cylinder, but it is also possible to interconnect all the working chambers of the pressure cylinders.

In order to balance out any deviation present in the parallelism of the sides of the roll gap, which deviation arises from the fact that the contact pressure on one side of the rolls is greater than on the other side, for instance as a result of higher friction of the bearing housings on one side of the machine frame, it is possible to switch a pump between the connected system of all working chambers on one side of the roll press and the system of all connected working chambers on the opposite side of the roll press. This pump in this case balances the force to both sides of the roll gap.

As a result of the type of interconnection of the rolls and the force compensation of the working chambers of a respective pressure cylinder, the position of the rolls in the machine frame is statically indeterminate, for the rolls can change the linear and also the rotary position insofar as the possible stroke in the pressure cylinders allows. It is therefore necessary, in addition to the large-sized pressure cylinders, to use control cylinders which determine the position of the rolls.

To this end, it is provided according to the invention to connect the bearing housings of the rolls movably to the machine frame by means of control cylinders. The machine frame here, as a counter bearing for the control cylinder, has only to absorb the force which is necessary to position the rolls, but not the force which is necessary to maintain the pressure in the roll gap.

In one embodiment of the invention, it is provided that four control cylinders are connected to the machine frame, respectively one control cylinder being connected to respectively one bearing housing of the two rolls. Respectively in pairs, the control cylinders control the position of the rolls. Paired crosswise, the roll pairs determine the rotary position of the rolls and, paired in parallel, the control cylinders determine the linear position of the rolls in the machine frame.

The working chambers of the control cylinders are interconnected by means of a pump working in four-quadrant operation. This pump can thus influence the linear and the rotary position in which the pressure medium present in the control system is pumped from one control cylinder pair into the other pair.

Similarly, it is possible to design each control cylinder such that a working chamber is present to both sides of the piston, so that the quantity of the oil present in the control system is the same with each position of the two rolls. In order to influence the position of the roll gap, the eight working chambers of the four control cylinders can be connected up correspondingly. The person skilled in the art is here free to determine the appropriate driving of the control cylinders.

If the position of the roll gap is determined by the control system, the force of the control cylinders can be used as an additional pressure force, which, however, must be dissipated via the machine frame as a counter bearing, in contrast to the pressure force applied by the pressure cylinders having at least two working chambers and the connection thereof in such a way that pressure medium can circulate.

In one embodiment of the invention, it is provided that a machine frame respectively accommodates between two beams two bearing housings such that these are movable in one direction. The bearing housings here contain the bearings for the shafts and are embraced, on respectively an outer side in relation to the movable direction in the machine frame, by a transverse member, the transverse member being articulately connected to respectively two pressure cylinders each having at least two working chambers with opposite force direction and connected in such a way that pressure medium can circulate. The pressure cylinders draw the transverse members together and pull the bearing housings along with them, since the transverse members embrace the bearing housings.

For the change of rolls, it is thus merely necessary to open the machine frame, to detach the hinge joints from the transverse members and/or the pressure cylinders, and to slide the rolls, together with the bearing housings, out of the frame. Since the pressure cylinders are fixedly connected to the frame, they do not need to be detached or hung separately, which renders a rapid roll change possible.

BRIEF DESCRIPTION OF THE DRAWINGS

The invention is explained greater detail with reference to the following figures, wherein.

DETAILED DESCRIPTION OF THE DRAWINGS

Figure 1:
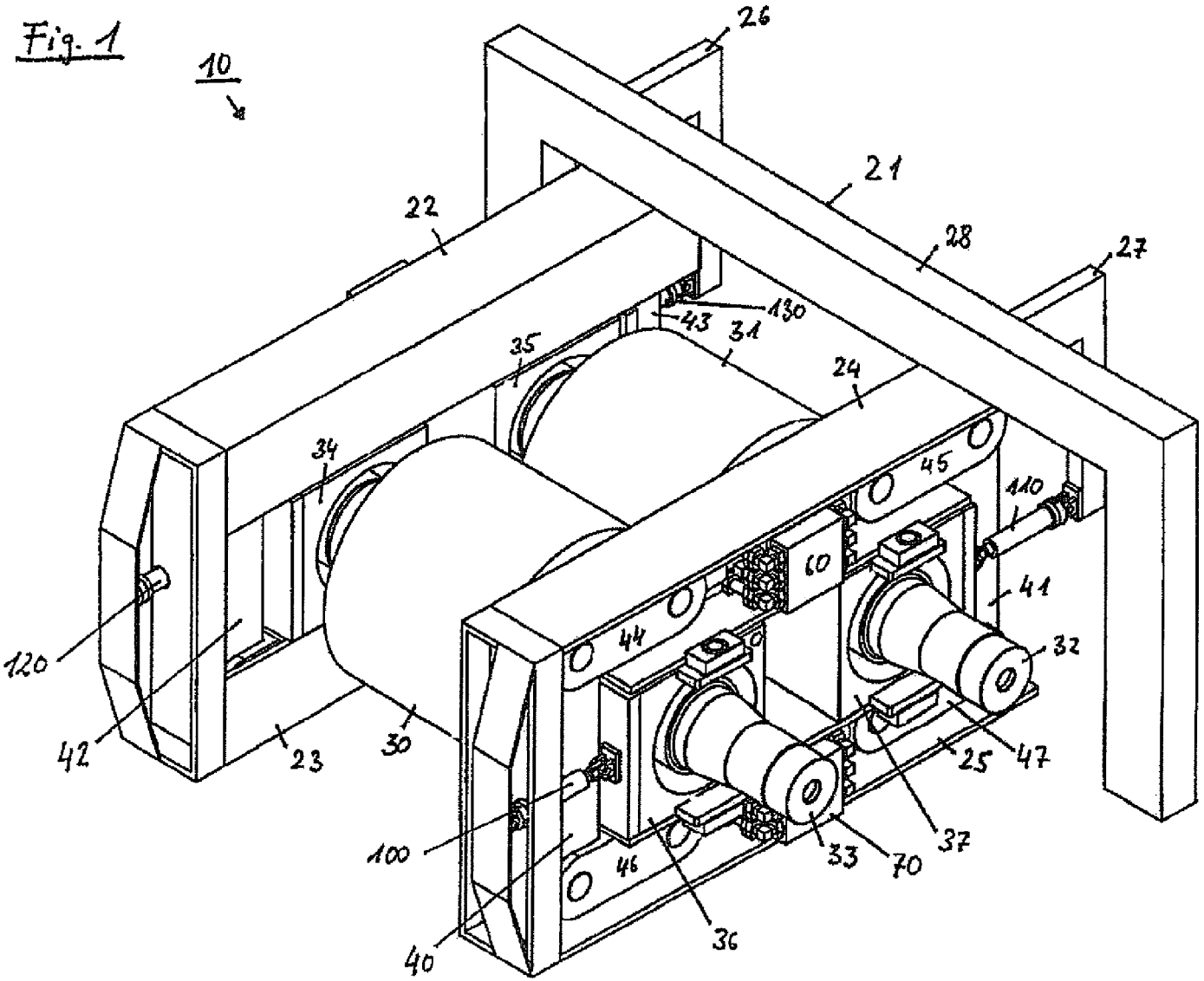
FIG. 1 shows a perspective view of a roll press according to the invention.

In FIG. 1, a roll press 10 according to the invention is represented, which has a machine frame 21 accommodating the components of the roll press 10. The machine frame 21 comprises, apart from further subcomponents, the frame elements 22, 23, 24 and 25, as well as the extension arms 26 and 27, which, via a bridge 28, form a unit with the machine frame 21. In the machine frame 21 are accommodated the rolls 30 and 31, which are configured as mobile rolls, and the rolls 30 and 31 are mounted by means of the shafts 32 and 33 in bearing housings 34, 35, 36 and 37, in which corresponding shaft bearings are located. In the roll press 10, the bearing housings 34, 35, 36 and 37 are embraced by transverse members 40, 41, 42 and 43, which are mutually connected by means of drag links 44, 45, 46, 47, 48, 49, 50 and 51 to the pressure cylinders 60, 70, 80 and 90, in this perspective view the pressure cylinders 80 and 90 not being visible. These are disposed behind the plane of the paper and are concealed by the frame elements 22 and 23, as well as by the rolls 30 and 31.

The rolls 30 and 31 are arranged, by means of the shafts 32 and 33 and the bearing housings 34, 35, 36 and 37, floatingly in the machine frame 21. This means that the rolls 30 and 31 can slide to and fro along the frame elements 22, 23, 24 and 25 or twist rotationally in these, insofar as the stroke in the pressure cylinders 60, 70, 80 and 90 allows. The position of the rolls 30 and 31 is here adjusted by means of the control cylinders 100, 110, 120 and 130, the control cylinders 100 and 120 acting on a vertical subcomponent of the machine frame 21 and respectively connecting a bearing housing 34 and 36 movably to the machine frame 21. Both control cylinders 100 and 120 interact with further control cylinders 110 and 130, disposed on extension arms 26 and 27, in order to control the position of the first closed system of forces from the bearing housings 36 and 37, the drag links 44, 45, 46 and 47 and from the transverse members 40 and 41, and of the second closed system of forces from the bearing housings 34 and 35 and from the drag links (not represented) and the transverse members, which in this view point toward the back of the paper.

In contrast to the force of the pressure cylinders 60, 70, 80 and 90, the force of the control cylinders 100, 110, 120 and 130 is dissipated via the machine frame 21 as a counter bearing.

Figure 2:
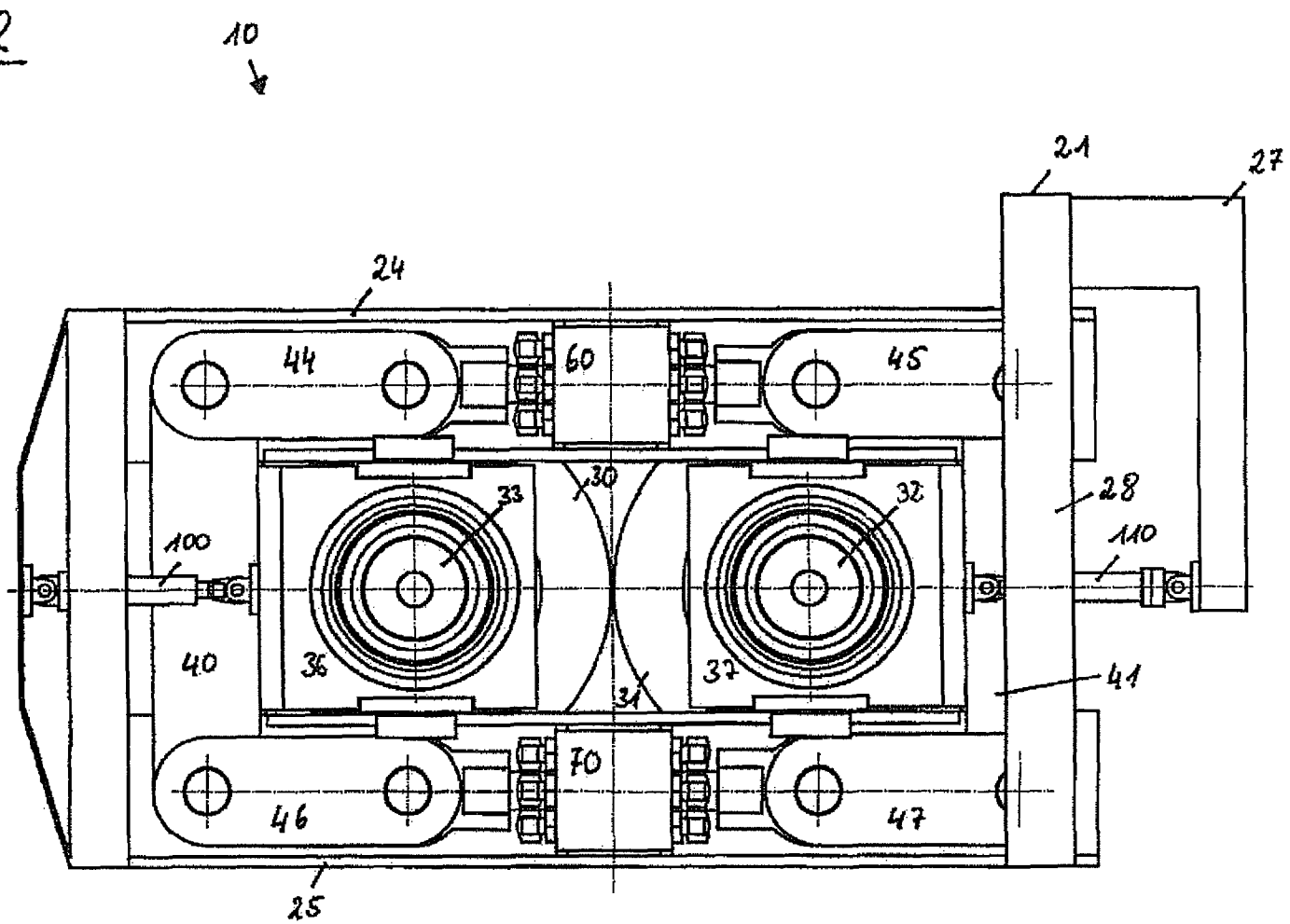
FIG. 2 shows a side view of the roll press according to the invention.

In FIG. 2, the roll press 10 is represented in a side view, the closed system of forces being clearly discernible from the transverse members 40 and 41, from the drag links 44, 45, 46 and 47 connecting them to the pressure cylinders 60 and 70, and from the bearing housings 36 and 37. Even though the pressure cylinders 60 and 70 are fixedly connected to the frame elements 24 and 25, by the pressure cylinders 60 and 70 no other force is exerted upon the machine frame 21 than those which are generated by the friction of the pistons 64 and 65 in the cylinders of the pressure cylinders 60 and 70.

The machine frame 21 is constructed such that it is closed to the left and open to the right, the control cylinders 110 and 130 (here not visible) acting on extension arms 26 (not visible) and 27 in order to control the position of the abovementioned, closed system of forces. The machine frame 21 is connected by the extension arms 26 and 27 by a bridge 28 connecting these to the frame elements 22 and 24. As a result of this configuration of the machine frame 21, it is possible to remove the light control cylinders 110 and 130, to detach the transverse members 40 and 41 from the drag links 45, 47, such that the rolls 30 and 31, together with the bearing housings 34, 35, 36, 37, can be pulled out between the frame elements 22 and 24, a corresponding disassembly being necessary on the opposite side. To this end, the bridge 28 is dimensioned sufficiently wide that the rolls 30 and 31, together with the shafts 32 and 33, can be removed from the machine frame 21 without the need for greater works, such as the dismantling of a hydraulics system.

Figure 3:
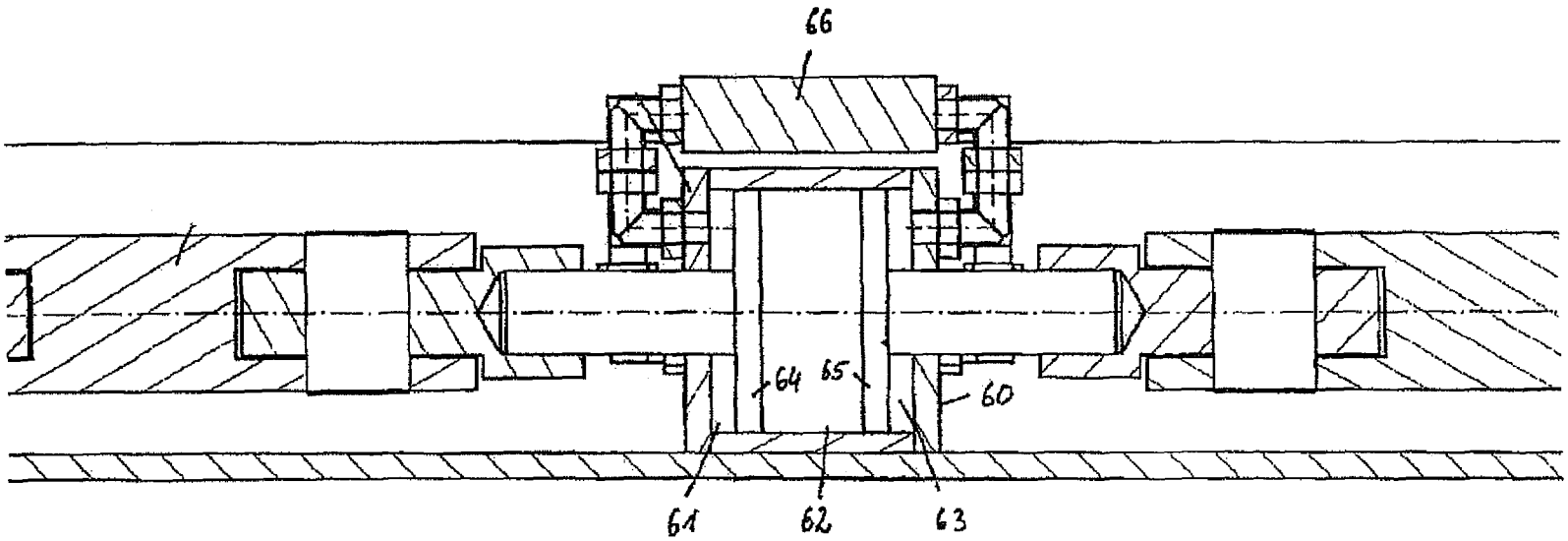
FIG. 3 shows a schematic representation of a pressure cylinder according to the invention.

In FIG. 3, a schematic view of a pressure cylinder 60 is represented, which has three working chambers 61, 62 and 63 formed by the division of the pressure cylinder 60 by the two pistons 64 and 65. Insofar as only the two outer working chambers 61 and 63 are used to press against the two rolls 30 and 31, if the working chambers 61 and 63 are connected in such a way that pressure medium can circulate, the position of both pistons in the cylinder can vary, since the pistons act without force in relation to the fastening of the cylinder to the machine frame 21. For both working chambers 61 and 63 transmit an equal and opposite force to the pressure cylinder 60, so that this remains constantly force-neutral in relation to its own position. It is thereby possible to use a relatively small-sized machine frame 21, since this does not have to absorb the high forces of the pressure cylinders 60, 70, 80 and 90 as a counter bearing. In addition, it is possible to operate the pressure cylinder 60 fixedly, whereby the hydraulic supply can be realized by pipe lines, which are inflexible and more stable than flexible hoses which have limited pressure stability and are more fragile than a fixed pipe line for high pressures.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

REFERENCE SYMBOL LIST

| | |
|---|---|
| 10 | roll press |
| 21 | machine frame |
| 22 | frame element |
| 23 | frame element |
| 24 | frame element |
| 25 | frame element |
| 26 | extension arm |
| 27 | extension arm |
| 30 | roll |
| 31 | roll |
| 32 | shaft |
| 33 | shaft |
| 34 | bearing housing |
| 35 | bearing housing |
| 36 | bearing housing |
| 37 | bearing housing |
| 40 | transverse member |
| 41 | transverse member |
| 42 | transverse member |
| 43 | transverse member |
| 44 | drag link |
| 45 | drag link |
| 46 | drag link |
| 47 | drag link |
| 48 | drag link |
| 49 | drag link |
| 50 | drag link |
| 51 | drag link |
| 60 | pressure cylinder |
| 61 | working chamber |
| 62 | working chamber |
| 63 | working chamber |
| 64 | piston |
| 65 | piston |
| 66 | control block |
| 70 | pressure cylinder |
| 80 | pressure cylinder |
| 90 | pressure cylinder |
| 100 | control cylinder |
| 110 | control cylinder |

-continued

| | |
|---|---|
| 120 | control cylinder |
| 130 | control cylinder |

The invention claimed is:

1. A roll press for the compression or compacting of granular products, comprising:

two mobile rolls, separated by a roll gap, which are each mounted rotatably in a machine frame by means of a shaft and are driven in opposite directions, the shafts of the mobile rolls being accommodated in bearing housings at each end of the shafts, the bearing housings each being arranged movably in the machine frame, two of said bearing housings of different rolls, arranged on one end of the rolls, being interconnected to one another by at least one pressure cylinder having two pistons and three working chambers, and the working chambers of the at least one pressure cylinder having an oppositely directed force effect and being interconnected in such a way that pressure medium can circulate between two of the three working chambers.

2. The roll press as claimed in claim 1, wherein the at least one pressure cylinder is fixedly connected to the machine frame.

3. The roll press as claimed in claim 1, wherein a central chamber of the three chambers is filled with gas.

4. The roll press as claimed in claim 1, wherein a central chamber of the three chambers is evacuated.

5. The roll press as claimed in claim 1, wherein a central chamber of the three chambers is configured such that it may be aerated and deaerated.

6. The roll press as claimed in claim 1, wherein the at least one pressure cylinder is articulately connected to transverse members, which respectively embrace one of said bearing housings.

7. The roll press as claimed in claim 1, wherein the bearing housings are movably connected to the machine frame by control cylinders.

8. The roll press as claimed in claim 7, wherein working chambers of the control cylinders are interconnected with one another.

9. The roll press as claimed in claim 8, wherein the control cylinders are interconnected by a control apparatus working in four-quadrant operation.

10. A method for centering two mobile rolls in a roll press for the compression or compacting of granular products, having two mobile rolls, separated by a roll gap, which respectively are mounted rotatably in a machine frame by their own shaft and are driven in opposite directions, wherein the shafts of the mobile rolls are at each of their ends accommodated in bearing housings arranged movably in the machine frame, and wherein respectively two of said bearing housings of different mobile rolls, arranged on one side of the mobile rolls, are interconnected to one another by at least one pressure cylinder having three working chambers, the method comprising the steps:

connecting the three working chambers of the at least one pressure cylinder with each other, and circulating a pressure medium between the three working chambers of the at least one pressure cylinder.

11. The method as claimed in claim 10, including a step of positioning the roll gap by control cylinders, which control cylinders extend between one of said movable bearing housings and the machine frame.

12. The method as claimed in claim 11, including a step of controlling the control cylinders with a control apparatus.

* * * * *